US007811099B2

(12) United States Patent
Lapidot et al.

(10) Patent No.: US 7,811,099 B2
(45) Date of Patent: Oct. 12, 2010

(54) DIFFERENTIAL SIGNAL TRANSMISSION CONNECTOR AND BOARD MOUNTABLE DIFFERENTIAL SIGNAL CONNECTOR FOR CONNECTING THEREWITH

(75) Inventors: Doron Lapidot, Tokyo (JP); Masayuki Aizawa, Tokyo (JP); Isao Igarashi, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 171 days.

(21) Appl. No.: 12/093,815

(22) PCT Filed: Nov. 2, 2006

(86) PCT No.: PCT/JP2006/321982

§ 371 (c)(1),
(2), (4) Date: May 15, 2008

(87) PCT Pub. No.: WO2007/058079

PCT Pub. Date: May 24, 2007

(65) Prior Publication Data

US 2009/0181564 A1 Jul. 16, 2009

(30) Foreign Application Priority Data

Nov. 17, 2005 (JP) ..... 2005-333152

(51) Int. Cl.
*H01R 13/648* (2006.01)

(52) U.S. Cl. ..... 439/108

(58) Field of Classification Search ..... 439/101, 439/108

See application file for complete search history.

(56) References Cited

U.S. PATENT DOCUMENTS

| | | | | |
|---|---|---|---|---|
| 6,350,134 | B1 * | 2/2002 | Fogg et al. | 439/79 |
| 6,457,983 | B1 * | 10/2002 | Bassler et al. | 439/108 |
| 6,540,559 | B1 * | 4/2003 | Kemmick et al. | 439/607.05 |
| 6,575,789 | B2 * | 6/2003 | Bassler et al. | 439/607.23 |
| 7,156,672 | B2 * | 1/2007 | Fromm et al. | 439/101 |

FOREIGN PATENT DOCUMENTS

| | | |
|---|---|---|
| JP | 11273800 | 10/1999 |
| JP | 2002-094203 | 3/2002 |
| JP | 2004-534358 T | 11/2004 |

* cited by examiner

*Primary Examiner*—Briggitte R Hammond
(74) *Attorney, Agent, or Firm*—Barley Snyder LLC

(57) ABSTRACT

A differential signal transmission connector includes an insulative housing. A plurality of pairs of differential signal transmission contacts and a plurality of grounding contacts are provided in the insulative housing. The differential signal transmission contacts and the grounding contacts are arranged in two rows. A first contact from each of the pairs of the differential signal transmission contacts is arranged in a first row, and a second contact from each of the pairs of the differential signal transmission contacts is arranged in a second row. The grounding contacts are arranged in the first row between each of the first contacts and the grounding contacts are arranged in the second row between each of the second contacts.

7 Claims, 9 Drawing Sheets

DIFFERENTIAL SIGNAL TRANSMISSION CONNECTOR AND BOARD MOUNTABLE DIFFERENTIAL SIGNAL CONNECTOR FOR CONNECTING THEREWITH

CROSS-REFERENCE TO RELATED APPLICATIONS

This application claims the benefit of the filing date under 35 U.S.C. §120(d) of International Patent Application No. PCT/JP2006/321982 filed Nov. 2, 2006 which claims the priority of Japanese Patent Application No. 2005-333152 filed Nov. 17, 2005.

FIELD OF THE INVENTION

The present invention relates to a differential signal transmission connector and to a board mountable differential signal transmission connector for engaging the differential signal transmission connector. The differential signal transmission connector and the board mountable differential signal transmission connector are used for high speed digital differential signal transmission, such as transmission of digital signals between an image display device and a control device for controlling the image display device.

BACKGROUND

A board mountable differential signal transmission connector, in which contact sets (triplet) each constituted by a pair of differential signal transmission contacts and a single grounding contact in a triangular formation, with adjacent triplets being inverted with respect to each other, are provided in two rows of contacts in an engaging portion (PCT Japanese Publication No. 2004-534358). Twisted pair cables, in which positive signal lines and negative signal lines are twisted with each other, are utilized as cables to be connected to the differential signal transmission contacts, because these cables are suited for digital transmission. In an engaging portion of this differential signal transmission connector, the pair of differential signal transmission contacts of a first contact set that constitutes triplet, that is, signal contacts, is provided in a first row, and the grounding contact of the contact set is provided in a second row. Meanwhile, the grounding contact of a second contact set adjacent to the first contact set is provided in the same row as the pair of signal contacts of the first contact set, and the pair of signal contacts of the second contact set is provided in the same row as the grounding contact of the first contact set.

The arrangement of the signal contacts and grounding contacts in the two rows within the engaging portion are converted to a single row at a board connecting portion of the board mountable differential signal transmission connector. The contacts within the single row are connected to a circuit board by solder.

PCT Japanese Publication No. 2004-534358 is silent regarding a connector of a cable to be connected to the board mountable differential signal transmission connector. However, it is considered that the connector of the cable has a plurality of contact sets that form triplets that include differential signal transmission contacts and grounding contacts corresponding to those of the board mountable differential signal transmission connector.

Recently, digital signal transmission at speeds higher than those heretofore is in demand. For example, there is demand for digital signal transmission at speeds of 1 to 5 Gb/sec.

Accompanying this demand, connectors which are capable of high speed digital signal transmission without generating skew (time differences in signal reception) and crosstalk, are also in demand. Generally, as the transmission frequency increases, current becomes concentrated toward the surfaces of core wires (conductors) of wires (surface effect). High speed digital signal transmission is transmission of high frequency signals. Accordingly, in cases that high speed digital signals are transmitted, the attenuation rate of signals becomes great, particularly when the lengths of cables become long. Therefore, large diameter signal cables having large core wire surface areas become necessary.

The concept of providing signal contacts and a grounding contact of a differential signal transmission connector to form a triangular shape is schematically illustrated in FIG. 10A. In FIG. 10A, small diameter wires d1 and d2, which are connected to signal contacts s1 and s2 in a first row, and a grounding wire dg, which is connected to a grounding contact G1, form a triangular shape. Wires of American Wire Gauge (AWG) #30 may be used as the wires d1, d2 and the grounding wire dg. Here, the pitch between the wires d1 and d2 is denoted as P. Meanwhile, it is not possible to connect large diameter signal wires D1 and D2 to the signal contacts s1 and s2 and to connect the grounding wire dg to the grounding contact G1, because the surfaces of the insulators of the wires D1 and D2 interfere with each other, as illustrated in FIG. 10B. The wires D1 and D2 may be AWG #24 wires. In FIG. 10B, the portions of the wires D1 and D2 that interfere with each other are illustrated by hatching. If the pitch P is increased, it will be possible to utilize the large diameter wires D1 and D2. However, this will cause a problem that the size of the connector in the direction that the signal contacts s1 and s2 are arranged will become larger. Generally, a predetermined number of wires must be provided within a limited space. Accordingly, it is not realistic to increase the pitch between the wires, which will result in the connector itself becoming larger. Additionally, as shown in FIG. 10B, single grounding contact is provided between the two closest contact sets, which are provided inverted from each other, in order to prevent crosstalk. However, there is a possibility that signal contacts of separate contact sets will become too close to each other, thereby generating crosstalk therebetween.

SUMMARY

The present invention has been developed in view of the foregoing points. It is an object of the present invention to provide a differential signal transmission connector and a board mountable differential signal transmission connector suited for high speed digital signal transmission, that enable utilization of large diameter wires without the large diameter wires interfering with each other, and also without increasing the sizes of the differential signal transmission connector and the board mountable differential signal transmission connector. It is another object of the present invention to provide a differential signal transmission connector which is adapted to utilize wires having a variety of diameters over a wide range. It is still another object of the present invention to provide a differential signal transmission connector and a board mountable differential signal transmission connector suited for high speed digital signal transmission, in which crosstalk among the closest differential signal transmission contacts of different contact pairs is greatly reduced.

This and other objects are achieved by a differential signal transmission connector comprising an insulative housing. A plurality of pairs of differential signal transmission contacts and a plurality of grounding contacts are provided in the insulative housing. The differential signal transmission contacts and the grounding contacts are arranged in two rows. A first contact from each of the pairs of the differential signal transmission contacts is arranged in a first row, and a second contact from each of the pairs of the differential signal transmission contacts is arranged in a second row. The grounding contacts are arranged in the first row between each of the first contacts and the grounding contacts are arranged in the second row between each of the second contacts.

DETAILED DESCRIPTION OF THE EMBODIMENT(S)

Figure 1:
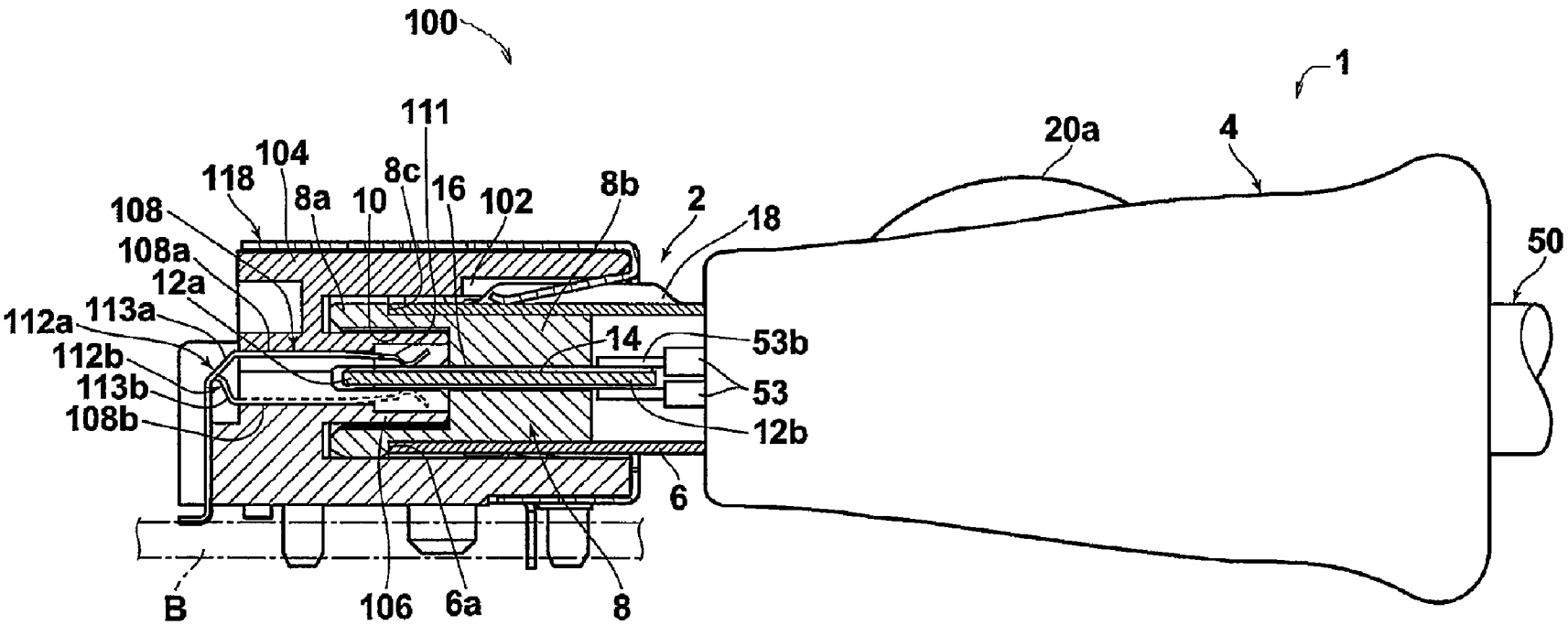
FIG. 1 is a partial sectional view that illustrates a differential signal transmission connector, which is connected to a cable, and a board mountable differential signal transmission connector, which is in engagement with the differential signal transmission connector.
Figure 2A:
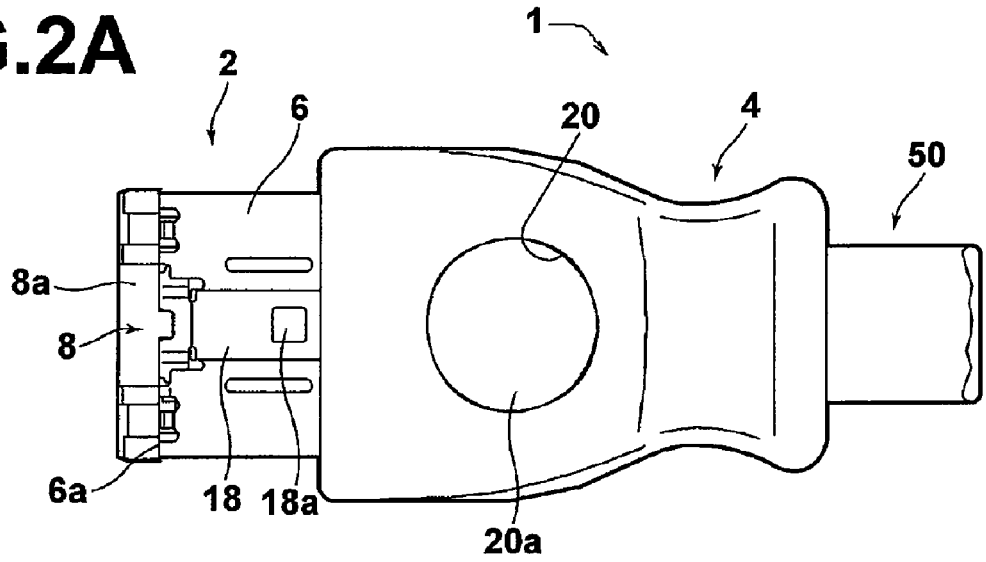
FIG. 2A is a plan view of the differential signal transmission connector which is connected to the cable.
Figure 2B:
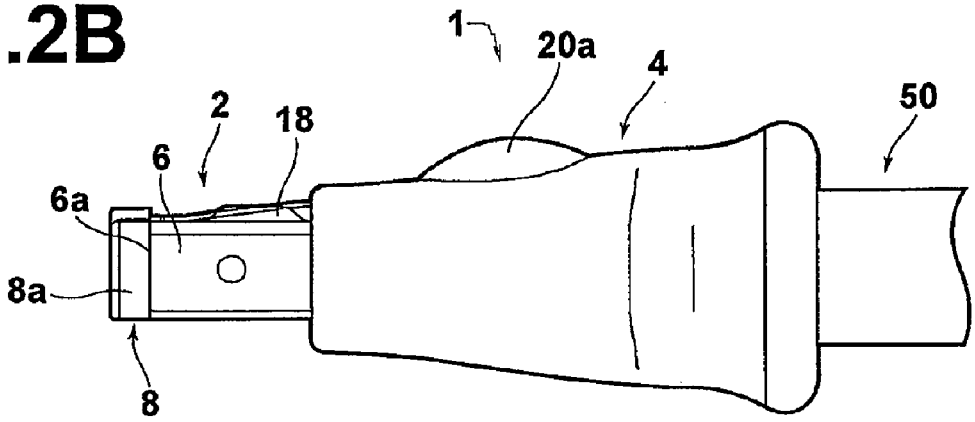
FIG. 2B is a side view of the differential signal transmission connector which is connected to the cable.
Figure 2C:
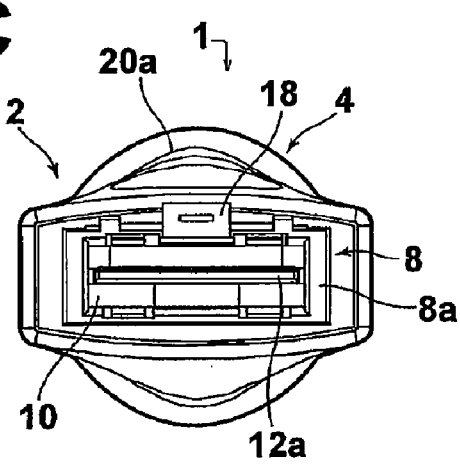
FIG. 2C is a front view of the differential signal transmission connector which is connected to the cable.

Hereinafter, the best embodiments of a differential signal transmission connector 1 and a board mountable differential signal transmission connector 100 of the present invention will be described with reference to the attached drawings. FIG. 1 is a partial sectional view that illustrates the differential signal transmission connector 1 (hereinafter, simply referred to as the "connector"), which is connected to a cable 50 and the board mountable differential signal transmission connector 100 (hereinafter, simply referred to as the "board mountable connector"), which is in engagement with the connector 1. In FIG. 1, the board mountable connector 100 is illustrated in cross section, and only an engaging portion 2 of the connector 1 is illustrated in cross section. FIGS. 2A-2C illustrate the connector 1 which is connected to the cable 50, wherein FIG. 2A is a plan view, FIG. 2B is a side view, and FIG. 2C is a front view. Note that in the following description, the side of the engaging portion 2 of the connector 1 will be referred to as the front side. First, the connector 1 will be described with reference to FIG. 1 and FIG. 2. The connector 1 is constituted by an insulative synthetic resin enclosure 4; an electromagnetic shield or metal shield shell 6, which is held at the front portion of the enclosure 4; and an insulative housing 8, which is held at the front portion of the shield shell 6. The shield shell 6 is formed by punching and bending a metal plate into a frame shape and substantially covers the insulative housing 8.

The insulative housing 8 is constituted by: a front portion 8*a*, which is exposed at a front end 6*a* of the shield shell 6; and a shielded portion 8*b*, which is shielded within the shield shell 6. A step 8*c* is formed about the entire periphery of the insulative housing 8 at the border between the front portion 8*a* and the shielded portion 8*b*. The front end 6*a* of the shield shell 6 is positioned at the step 8*c*. An engagement recess 10 that extends into the shielded portion 8*b* is formed in the front surface (engagement surface) of the front portion 8*a* of the insulative housing 8. Plate members 12*a* and 12*b* (wire connecting portions) that extend in both the insertion/extraction direction and in the width direction of the connector 1 are integrally formed with the insulative housing 8 at the center of the engagement recess 10 and at the center of the rear portion of the insulative housing 8, respectively. The plate member 12*a* extends toward the front within the engagement recess 10, while the plate member 12*b* extends toward the rear of the insulative housing 8. Contact insertion apertures 14 that extend along the upper and lower surfaces of the plate members 12*a* and 12*b* are formed in the insulative housing 8. Differential signal transmission contacts 16 (hereinafter, simply referred to as the "contacts") arranged in pairs consisting of positive signal contacts 16*a* and negative signal contacts 16*b* and grounding contacts 16*c* are press fit and mounted into the contact insertion apertures 14 (refer to FIG. 4). Meanwhile, core wires 53*b* (conductors) of a plurality of the wires 53, which are housed within the cable 50, are soldered to the plate member 12*b* at the rear portion of the contact 16.

Note that an elastic locking piece 18, which has a fixed front end and is for engaging with the board mountable connector 100, is provided on the front upper surface of the shield shell 6 of the connector 1. An engaging aperture 18*a* (refer to FIG. 2A) that engages with an engaging protrusion (not shown) of the board mountable connector 100 when the connector 1 engages with the board mountable connector 100, is formed in the elastic locking piece 18. The elastic locking piece 18 cooperates with an operating button 20*a* that protrudes through a circular aperture 20 in the upper surface of the enclosure 4, such that the elastic locking piece 18 is flexed downward, that is, toward the shield shell 6, to disengage from the board mountable connector 100 when the operating button 20*a* is pressed. This structure is not the main feature of the present invention, and therefore, a detailed description thereof will be omitted.

Figure 3:
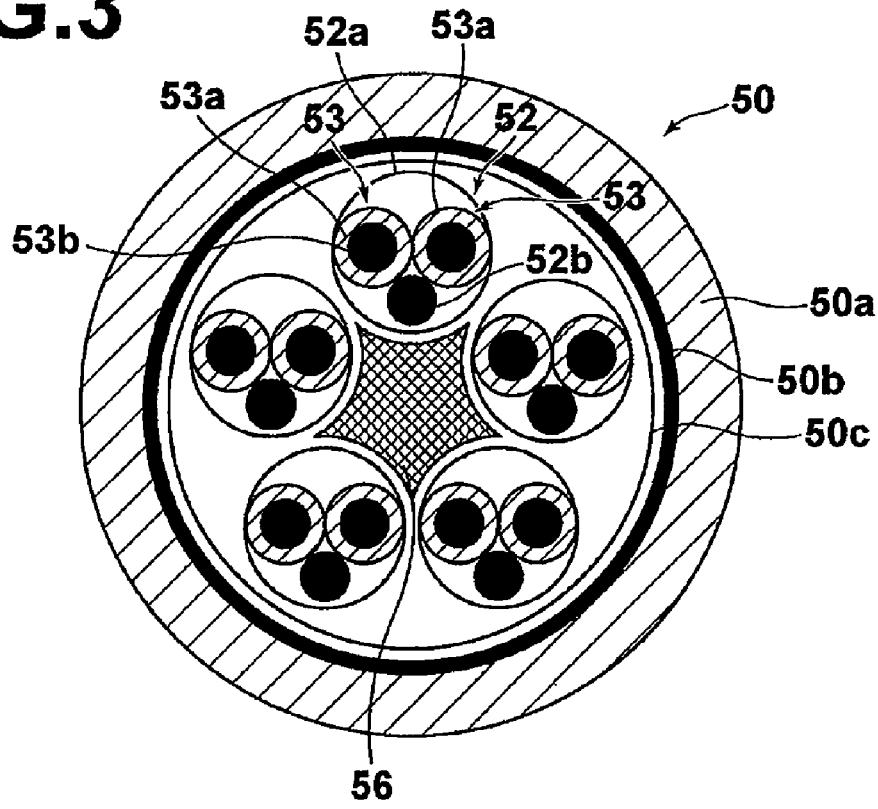
FIG. 3 is a schematic magnified horizontal cross sectional view of the cable, which is connected to the differential signal transmission connector.

Here, an example of the cable 50 utilized by the connector 1 will be described with reference to FIG. 3. FIG. 3 is a schematic magnified horizontal cross sectional view of the cable 50, which is connected to the connector 1. The cable 50 is constituted by: an insulative circular outer covering 50*a* (jacket); an electromagnetic shielding braided wire 50*b*, provided on the inner surface of the outer covering 50*a*; and a vapor deposited aluminum film layer 50*c* toward the interior of the braided layer 50*b*. Five thin diameter cables 52 are provided within the space inside the aluminum film layer 50*c*, about the periphery of a filler 56. All of the thin diameter cables 52 are of the same construction, and therefore only one of them will be described. The thin diameter cable 52 is constituted by: an insulative outer covering 52*a*, illustrated by the solid line; a pair of the wires 53; and a grounding wire 52*b*. The wires 53 and the grounding wire 52*b* are provided within the outer covering 52*a*. Although omitted from FIG. 3, a grounding conductor, such as a layer of aluminum film, is provided along the outer covering 52*a* so as to cover the wires 53 and the grounding wire 52*b*. Each of the two wires 53 is constituted by an insulative outer covering 53*a* and a conductor, that is, a core wire 53*b*. The pair of the wires 53 are housed within the outer covering 52*a* as a shielded twisted pair cable.

Figure 4:
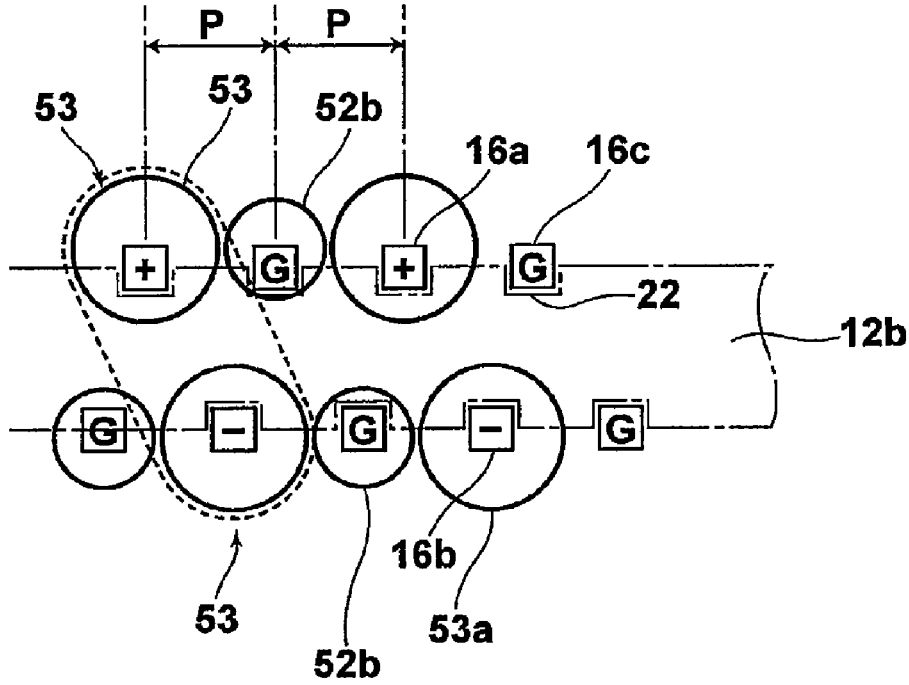
FIG. 4 is a schematic diagram that illustrates wires and grounding wires, which are soldered onto contacts on a plate member of the differential signal transmission connector.

Next, a state in which the core wires 53*b* of each of the wires 53 within the cable 50 are connected to the contacts 16 will be described with reference to FIG. 4. FIG. 4 is a schematic diagram that illustrates the wires 53 and the grounding wires 52*b*, which are soldered onto the contacts 16 on the plate member 12*b*. Grooves 22 corresponding to the contact insertion apertures 14 are formed in the surface of the plate member 12*b*, and the contacts 16 are positioned within the grooves 22. There are three types of contacts 16: the positive signal contacts 16*a*; the negative signal contacts 16*b*; and grounding contacts 16*c*. The outer coverings 53*a* of each of the core wires 53*b* of the twisted pairs of the wires 53, 53 are stripped, and the core wires 53*b* are soldered onto the positive signal contacts 16*a* (first contacts) positioned in an upper row (first row) of the plate member 12*b* and the negative signal contacts 16*b* (second contacts) positioned in a lower row (second row) of the plate member 12*b*. The grounding wires 52*b* are connected to the grounding contacts 16*c*, which are positioned between the positive signal contacts 16*a* and the negative signal contacts 16*b* of each of the rows. A single one of the grounding contacts 16*c* may be branched to be positioned at both sides of the plate member 12*b*. In this manner, the large diameter wires 53 can be provided to connect with the positive signal contacts 16*a* and the negative signal contacts 16*b* at the same pitch P as that in the case that conventional thin wires are utilized, without the outer coverings 53*a* interfering with each other.

Note that in FIG. 4, the positive signal contacts 16*a* are provided in the upper row, and the negative signal contacts 16*b* are provided in the lower row. Alternatively, this arrangement may be inverted. In addition, both the positive signal contacts 16*a* and the negative signal contacts 16*b* may be provided in both the upper and lower rows. In this case as well, the grounding contacts 16*c* must be provided between adjacent pairs of the positive signal contacts 16*a* and 16*a*, the positive and negative signal contacts 16*a* and 16*b*, or the negative signal contacts 16*b* and 16*b*. Further, the positions of the contacts 16 of the upper and lower rows may be slightly shifted in the horizontal direction as illustrated in FIG. 4, or they may be provided such that they are aligned in the vertical direction.

In this example, the contacts 16 which are formed from metal wire material are utilized. Alternatively, a substrate separate from the insulative housing 8 may be utilized, and conductive patterns corresponding to the contacts 16 may be formed on the substrate. In this case, a slot for inserting the substrate into is provided in the insulative housing 8 at the portion thereof corresponding to the plate members 12. The substrate, on which the conductive patterns are formed, is inserted into the slot and fixed therein. In the case that the contacts 16 are formed by the conductive patterns, grounding conductive patterns formed on one side of the substrate may be electrically connected to conductive patterns formed on the other side of the substrate, through holes therein. Equalizing circuits and the like may be formed on the substrate, if necessary.

Figure 5A:
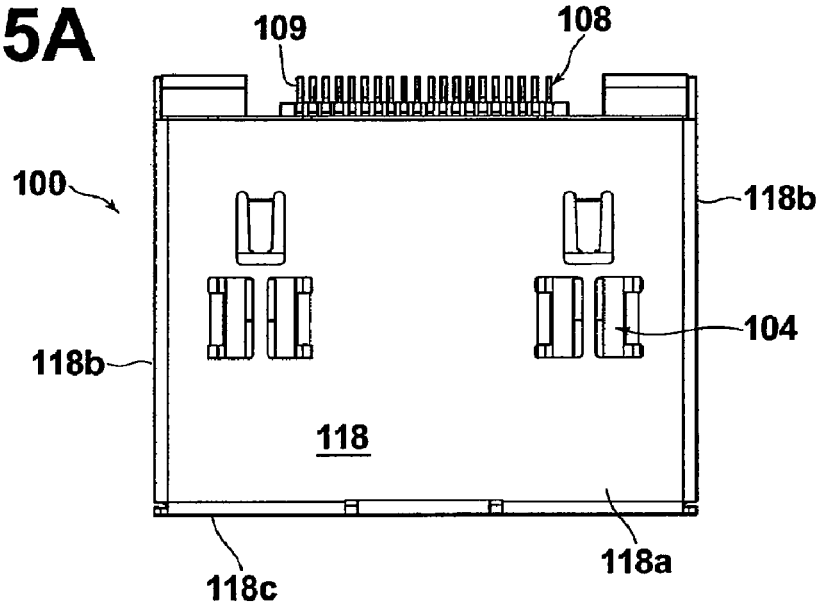
FIG. 5A is a plan view of the board mountable differential signal transmission connector of FIG. 1.
Figure 5B:
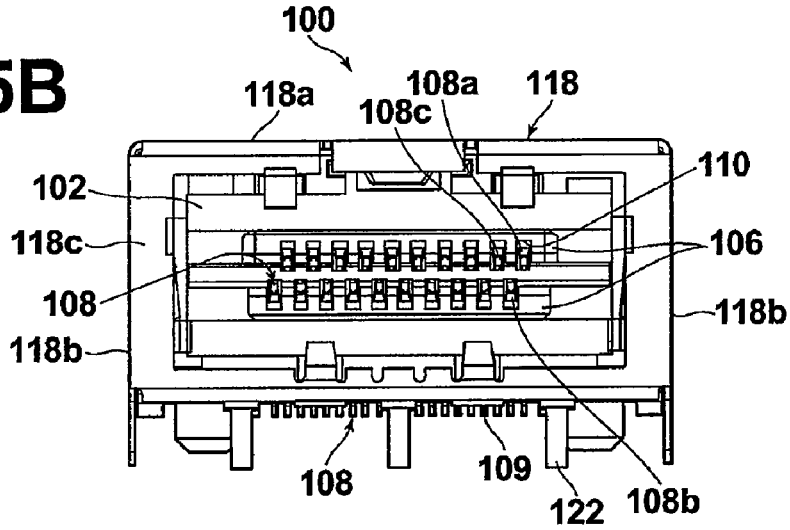
FIG. 5B is a front view of the board mountable differential signal transmission connector of FIG. 1.
Figure 5C:
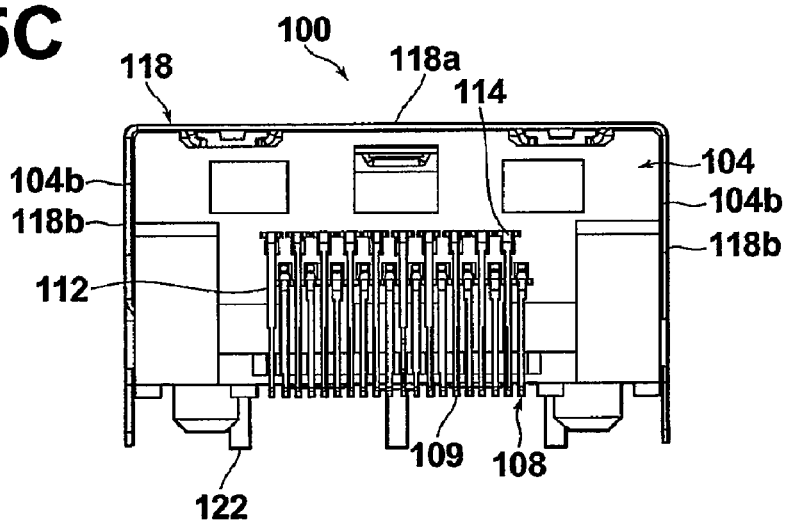
FIG. 5C is a rear view of the board mountable differential signal transmission connector of FIG. 1.
Figure 6:
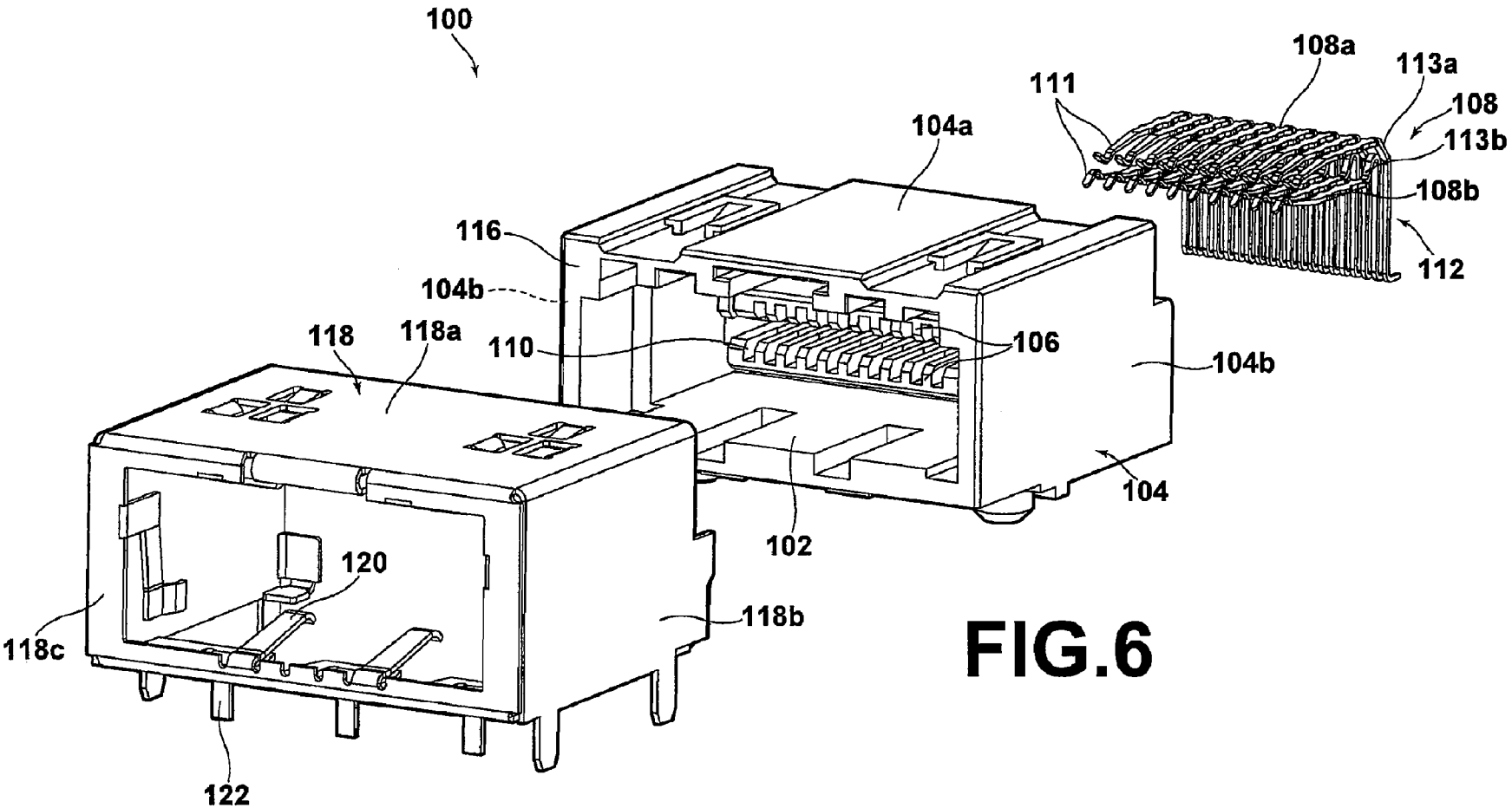
FIG. 6 is an exploded perspective view of the board mountable differential signal transmission connector of FIGS. 5A-5C.

Next, the board mountable connector 100 will be described with reference to FIG. 1, FIG. 5, and FIG. 6. FIGS. 5A-5C illustrate the board mountable connector 100, wherein FIG. 5A is a plan view, FIG. 5B is a front view, and FIG. 5C is a rear view thereof. FIG. 6 is an exploded perspective view of the board mountable connector 100 of FIG. 5. The board mountable connector 100 includes a substantially parallelepiped insulative housing 104. An engagement recess 102 that opens toward the front is formed in the insulative housing 104. The engaging portion 2 of the connector 1 is inserted into the engagement recess 102. A pair of horizontally extending ribs 106, which are separated from each other in the vertical direction, are formed integrally with the insulative housing 104 and protrude toward the front within the engagement recess 102. The plate member 12*a* of the connector 1 is inserted into the space between the ribs 106, 106 during engagement of the connector 1 and the board mountable connector 100. That is, the ribs 106 constitute the engaging portion of the board mountable connector 100. Contact receiving grooves 110, in which contacts 108 are provided, are formed in the surfaces of the ribs 106 that face each other. Contact insertion apertures 114 that communicate with the contact receiving grooves 110 are formed in the insulative housing 104. The contacts 108 are press fit into the contact insertion apertures 114 and fixed to the insulative housing 104.

There are three types of contacts 108: positive signal contacts 108*a* positioned in an upper row; negative signal contacts 108*b* positioned in a lower row; and grounding contacts 108*c*. Tine portions 112 (112*a*, 112*b*, 112*c*) of each of the contacts 108 (108*a*, 108*b*, 108*c*) extend out through the rear portion of the insulative housing 104 to be surface mounted onto a circuit board B (refer to FIG. 1). The lengths of the tine portions 112 of the positive signal contacts 108*a* and the lengths of the tine portions 112 of the negative signal contacts 108*b* are set to be equal. That is, the tine portions 112*a* of the positive signal contacts 108*a* include inclined portions 113*a* that incline obliquely in the downward direction, and the tine portions 112*b* of the negative signal contacts 108*b* include inclined portions 113*b* that incline obliquely in the upward direction, for example, as most clearly illustrated in FIG. 1. The inclined portions 113*a* and 113*b* extend rearward to substantially the same position. Thereby, the lengths of the tine portions 112*a* and 112*b* from the insulative housing 104 to the circuit board B, that is, the electric lengths thereof, become equal. Differences in transmission time of digital signals which are transmitted through the positive signal contacts 108*a* and the negative signal contacts 108*b*, that is, skew, is eliminated by the lengths of the tine portions 112*a* and 112*b* being equal. The contacts 108, which are arranged in two rows, are converted into a single row at a circuit board connecting portion 109, which are the bottoms of the tine portions 112 bent at right angles along the circuit board B (refer to FIG. 5A). Thereby, the area of the space of the circuit board B, which is occupied by the circuit board connecting portion 109, is decreased.

A shield shell 118 is provided to substantially cover the insulative housing 104 from the side of the front surface 116 thereof. The shield shell 118 is constituted by: a front wall 118*c* that covers a front surface 116 of the insulative housing 104; an upper wall 118*a* that extends rearward from a front wall 118*c* to cover an upper wall 104*a* (refer to FIG. 6) of the insulative housing 104; and side walls 118*b* that cover side walls 104*b* of the insulative housing 104. The front wall 118*c* constitutes an engagement surface of the board mountable connector 100. A plurality of grounding tongue pieces 120 are provided on the front wall 118*c*. The grounding tongue pieces 120 extend obliquely into the engagement recess 102 when the shield shell 118 is mounted onto the insulative housing 104. The grounding tongue pieces 120 contacts the shield shell 6 of the connector 1 to form a continuous grounding conductor, when the connector 1 and the board mountable connector 100 are engaged with each other. A plurality of downwardly extending retention legs 122, for electrically connecting the shield shell 118 with the circuit board B, are integrally formed with the shield shell 118.

Figure 7:
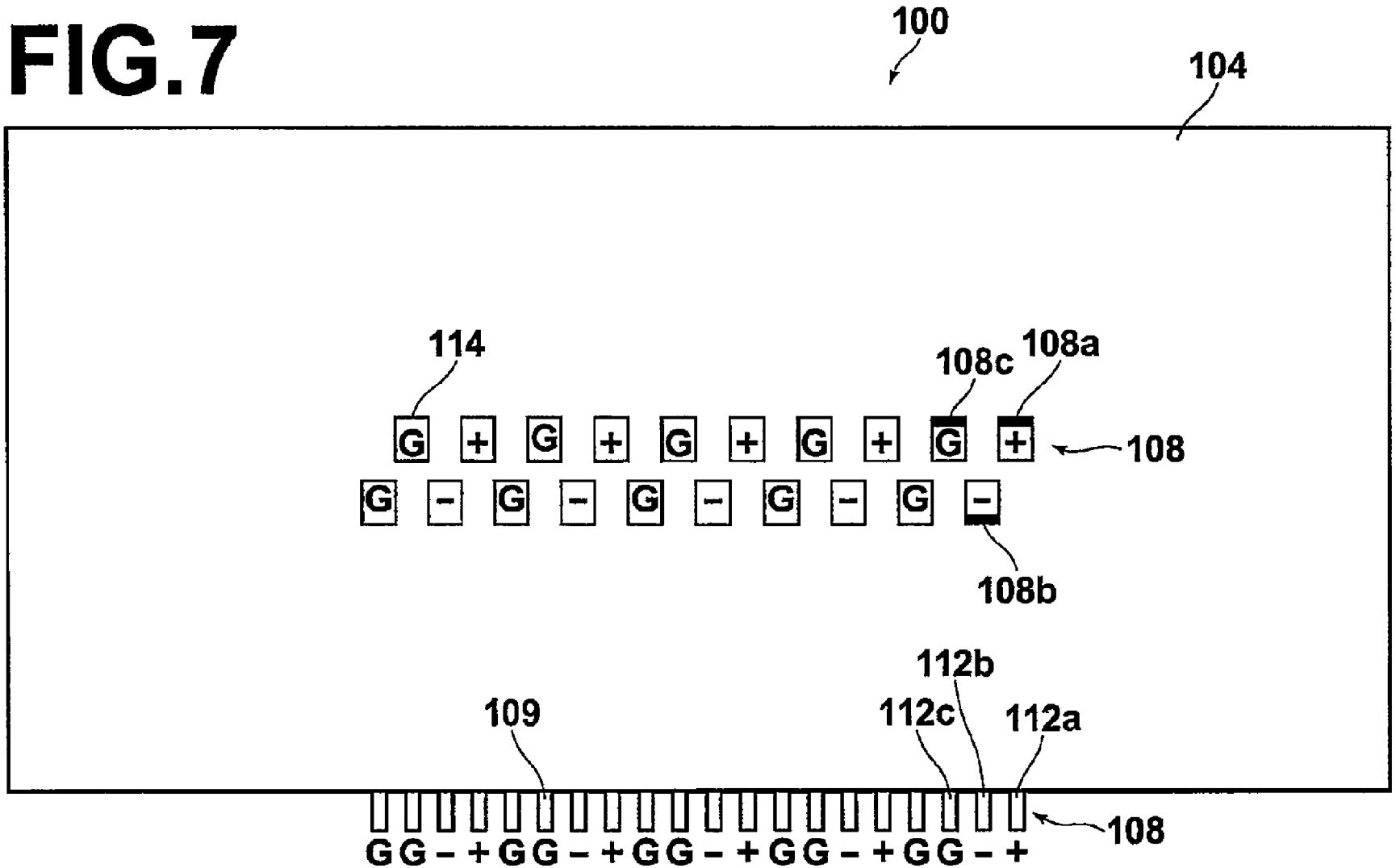
FIG. 7 is a schematic view of the board mountable differential signal transmission connector of FIGS. 5A-5C from the side of its engagement surface that illustrates the arrangement of contacts.

Next, the arrangement of the contacts 108 within the board mountable connector 100 will be described with reference to FIG. 7. FIG. 7 is a schematic view of the board mountable connector 100 from the side of its engagement surface that illustrates the arrangement of the contacts 108. The contact insertion apertures 114 are arranged in two rows at the approximate center of the insulative housing 104. The contacts 108 are provided in all of the contact insertion apertures 114. However, only a portion of the contacts 108 are illustrated in FIG. 7, while the a remainder of the contacts 108 are indicated only by their type. The positive signal contacts 108*a* and the grounding contacts 108*c* denoted by reference letter G are alternately arranged as the contacts 108 in the upper row. The negative signal contacts 108*b* and the grounding contacts 108*c* are alternately arranged as the contacts 108 in the lower row. The arrangement of the contacts 108 corresponds to the arrangement of the contacts 16 of the connector 1. Accordingly, the positions of the contacts 108 of the upper and lower rows may be shifted slightly in the horizontal direction as illustrated in FIG. 7, or they may be provided such that they are aligned in the vertical direction. By shifting the contacts 108 of the upper row half a half pitch with respect to the contacts 108 of the lower row, the contacts 108 may be arranged in a straight line when viewed from above. This facilitates manufacture of the contacts 108, and assembly of the contacts 108 into the insulative housing 104. In addition, the contacts 108 may be used as any of the positive signal contacts, the negative signal contacts, and the grounding contacts, simply by changing the direction in which they are bent. Note that the arrangement of the contacts 108 illustrated here is merely an example, and the arrangement of the contacts 108 is not limited to this particular embodiment. For example, the negative signal contacts 108*b* may be provided in the upper row, and the positive signal contacts 108*a* may be provided in the lower row, inverse from the configuration illustrated in FIG. 7. Alternatively, the positive signal contacts 108*a* and the negative signal contacts 108*b* may be provided in both the upper and lower rows, interposed among each other. In this case as well, grounding contacts 108*c* must be provided between adjacent pairs of the contacts 108. Two of the grounding contacts 108*c* are provided between each of the adjacent pairs of the contacts 108 at the circuit board connecting portion 109. This configuration greatly reduces crosstalk.

When the connector 1 and the board mountable connector 100, constructed as described above, engage each other, contact pieces 111 of the contacts 108 contact the contacts 16 at the plate member 12*a*, and an electrical connection is established between the connectors 1 and the board mountable connector 100.

Figure 8A:
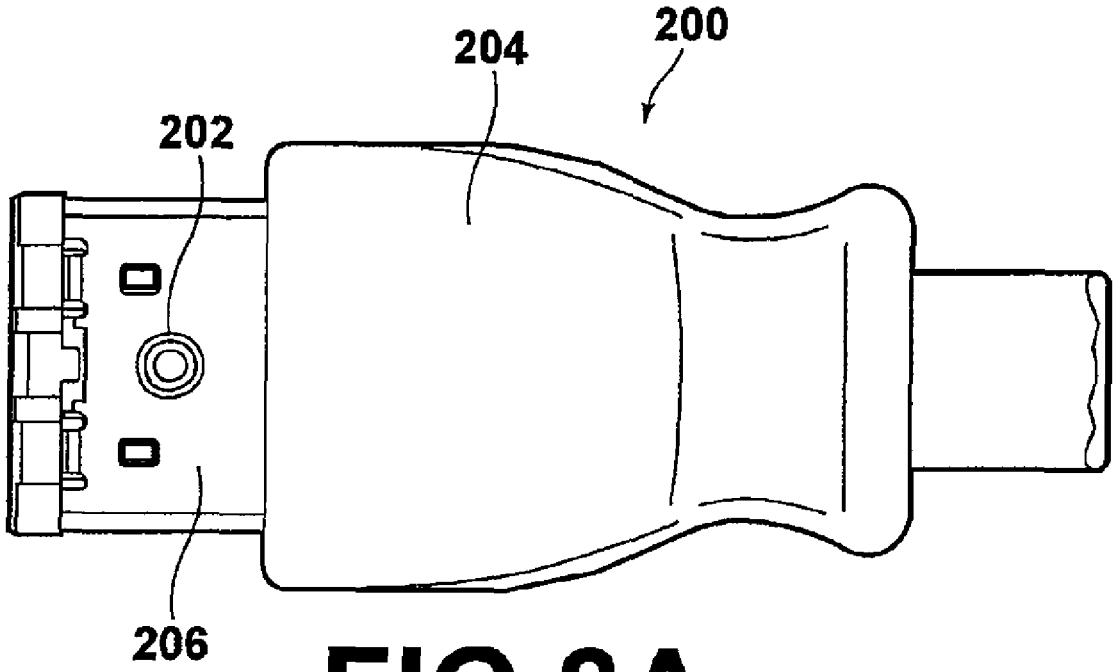
FIG. 8A is a plan view of a modified version of the differential signal transmission connector of FIG. 1.
Figure 8B:
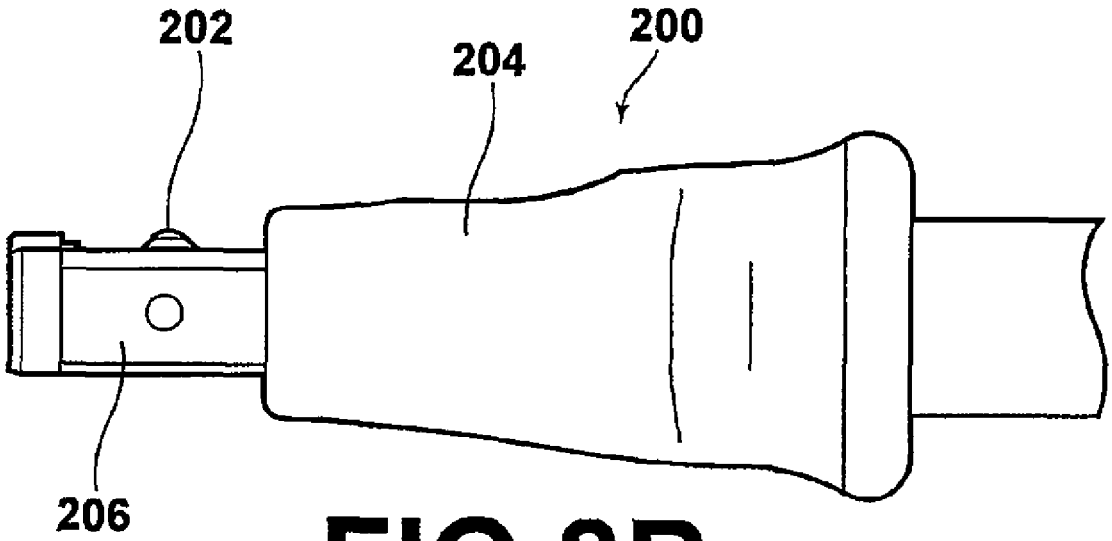
FIG. 8B is a side view of the modified version of the differential signal transmission connector of FIG. 1.

Next, a modified version of the connector 1 will be described with reference to FIGS. 8A-8B. FIGS. 8A-8B illustrate a cable connecting connector 200 similar to the connector 1 of FIG. 1, wherein: FIG. 8A is a plan view; and FIG. 8B is a side view. The connector 200 differs from the connector 1 in that a protrusion 202 is provided on the upper surface of a shield shell 206 instead of the elastic locking piece 18. The protrusion 202 is configured to frictionally engage the engagement recess 102 of the board mountable connector 100. Accordingly, the circular aperture 20 and the operating button 20*a* that protrudes therethrough of the connector 1 are not provided on the enclosure 204. The other components of the connector 200 are the same as those of the connector 1, and therefore detailed descriptions thereof will be omitted.

Figure 9:
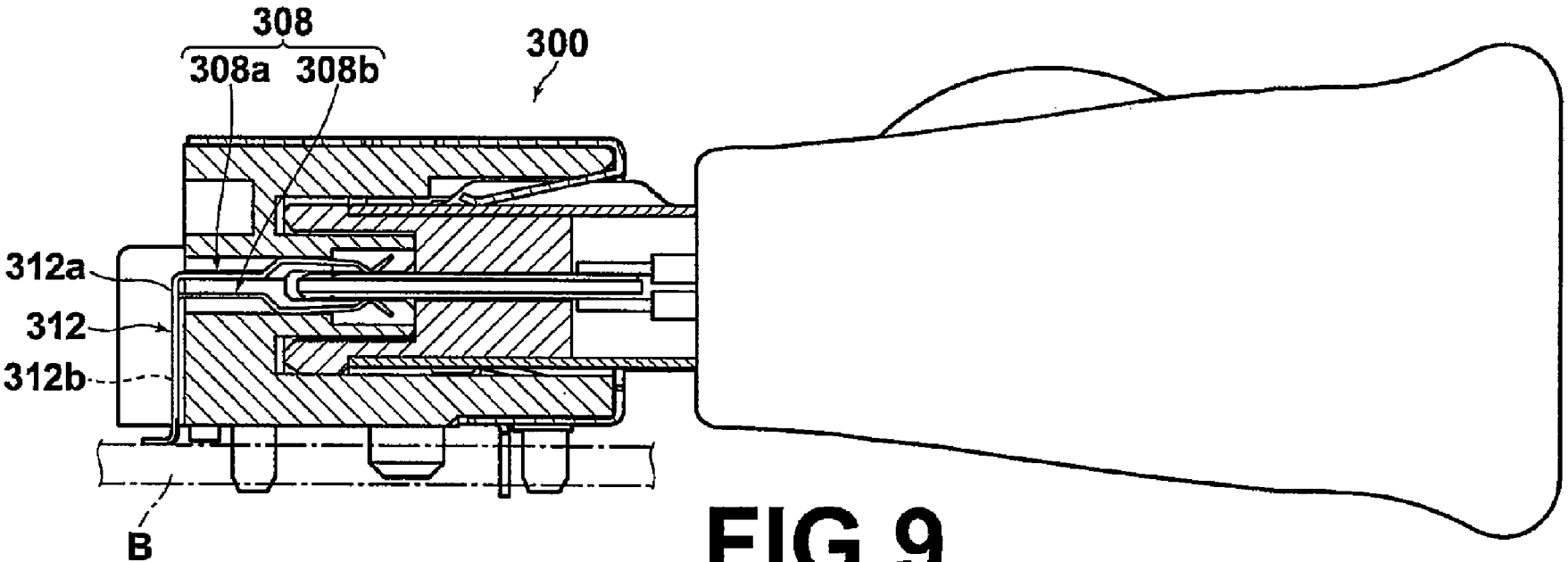
FIG. 9 is a partial sectional view of a modified version of the board mountable differential signal transmission connector of FIG. 1.
Figure 10A:
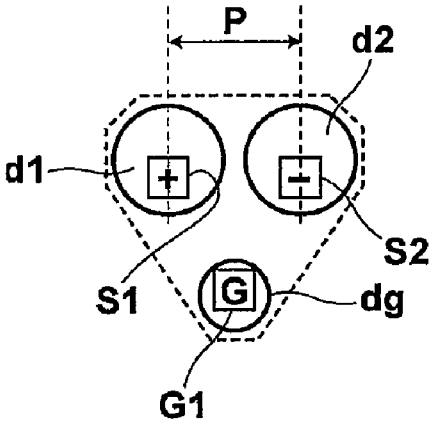
PRIOR ART FIG.10A
FIG. 10A is a schematic diagram illustrating signal contacts and a grounding contact of a differential signal transmission connector arranged in a triangular shape according to the prior art in which thin wires are connected.
Figure 10B:
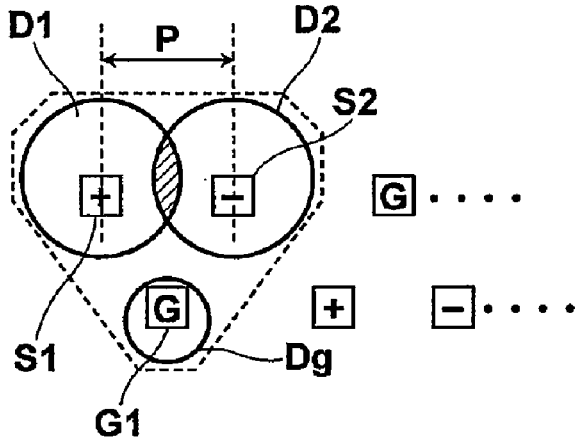
PRIOR ART FIG.10B
FIG. 10B is a schematic diagram illustrating signal contacts and a grounding contact of a differential signal transmission connector arranged in a triangular shape according to the prior art in which large diameter wires are connected.

Next, a modified version of the board mountable connector 100 will be described with reference to FIG. 9. FIG. 9 is a partial sectional view that illustrates a board mountable connector 300 which is similar to the board mountable connector 100 of FIG. 1. The board mountable connector 300 differs from the board mountable connector 100 in the shapes of tine portions 312 of contacts 308 thereof. The tine portions 312 of upper contacts 308*a* arranged in an upper row and lower contacts 308*b* arranged in a lower row all extend out from a housing 304, then are bent substantially at a right angle toward the circuit board B. Accordingly, the lengths of the tine portions 312*a* of the upper contacts 308*a* and the lengths of the tine portions 312*b* of the lower contacts 308*b* are different. However, because the number of bent portions is decreased, manufacture of the contacts 308 is facilitated.

What is claimed is:

1. A differential signal transmission connector, comprising:

an insulative housing; and a plurality of pairs of differential signal transmission contacts and a plurality of grounding contacts provided in the insulative housing, the differential signal transmission contacts and the grounding contacts being arranged in two rows, a first contact from each of the pairs of the differential signal transmission contacts being arranged in a first row and a second contact from each of the pairs of the differential signal transmission contacts being arranged in a second row, the grounding contacts being arranged in the first row between each of the first contacts and the grounding contacts being arranged in the second row between each of the second contacts.

2. The differential signal transmission connector of claim 1, wherein the a single one of the grounding contacts is branched between the first and second rows.

3. The differential signal transmission connector of claim 1, wherein the first contacts are positive signal contacts and the second contacts are negative signal contacts.

4. The differential signal transmission connector of claim 1, wherein first contacts and the grounding contacts in the first row are horizontally offset with respect to the second contacts and the grounding contacts in the second row.

5. The differential signal transmission connector of claim 1, wherein the differential signal transmission contacts and the grounding contacts are arranged in two rows at an engaging portion of the differential signal transmission connector.

6. The differential signal transmission connector of claim 1, wherein the first contacts and the grounding contacts in the first row are arranged at the same pitch as the second contacts and the grounding contacts in the second row.

7. The differential signal transmission connector of claim 6, wherein the pitch of the second contacts and the grounding contacts in the second row is offset by half of the pitch from the pitch of the first contacts and the grounding contacts in the first row.

* * * * *